US007735650B2

(12) United States Patent
Zumbiel

(10) Patent No.: US 7,735,650 B2
(45) Date of Patent: Jun. 15, 2010

(54) UNITARY PHARMACEUTICAL PACKAGE

(75) Inventor: Michael W. Zumbiel, Lakeside Park, KY (US)

(73) Assignee: The C.W. Zumbiel Company, Cincinnati, OH (US)

( * ) Notice: Subject to any disclaimer, the term of this patent is extended or adjusted under 35 U.S.C. 154(b) by 747 days.

(21) Appl. No.: 11/540,013

(22) Filed: Sep. 29, 2006

(65) Prior Publication Data

US 2008/0078690 A1 Apr. 3, 2008

(51) Int. Cl.
*B65D 83/04* (2006.01)

(52) U.S. Cl. ..... 206/532; 206/531; 206/534; 206/534.1; 206/538

(58) Field of Classification Search ..... 206/460, 206/528, 531–534, 534.1, 534.2, 538, 539
See application file for complete search history.

(56) References Cited

U.S. PATENT DOCUMENTS

| | | | | |
|---|---|---|---|---|
| 2,780,353 | A | 2/1957 | Volckening | |
| 3,324,996 | A | 6/1967 | Jordt | |
| 3,387,699 | A | 6/1968 | Heller | |
| 3,756,384 | A * | 9/1973 | Stone | 206/534 |
| 4,192,422 | A | 3/1980 | Kotyuk | |
| 4,340,141 | A | 7/1982 | Fischer | |
| 4,998,623 | A | 3/1991 | Doull | |
| 5,082,113 | A | 1/1992 | Romick | |
| 5,109,984 | A | 5/1992 | Romick | |
| 5,150,793 | A * | 9/1992 | Tannenbaum | 206/531 |
| 5,333,778 | A | 8/1994 | Specker | |

(Continued)

FOREIGN PATENT DOCUMENTS

GB 2266880 11/1993

*Primary Examiner*—Mickey Yu
*Assistant Examiner*—Sharon M Prange
(74) *Attorney, Agent, or Firm*—Wood, Herron & Evans, LLP

(57) ABSTRACT

A unitary pharmaceutical package according to this invention includes two primary components: a tubular sleeve-like carton or housing, and a medication card typically in the form of a blister pack in which multiple pre-formed pockets each enclose a pill. The medication card or sleeve has at least one upturned lip or flange along a longitudinal end of the card. The end walls of the carton are composite end walls formed by flaps which extend from the top, bottom, front and back panels. The unitary package of this invention easily and conveniently secures the medication card to the surrounding carton. After the carton sleeve is erected but prior to closing at least one of the composite end walls, the medication card is inserted longitudinally through one of the open ends of the carton. Some of the end flaps are folded inwardly so that they are tucked inside the carton on the interior of the upturned flange on the medication card. The bottom end flap is then folded upwardly to be juxtaposed in face-to-face relationship with the outer face of the upturned flange on the medication card. A strip of adhesive is then applied to the outer faces of the exposed portions of the upturned flange on the medication card and the lower major end flap. The remaining end flap is then folded downwardly to adhere to the exposed portions of the upturned flange and the lower major end flap. As a result, the carton is closed and sealed with the medication secured to the carton to avoid accidental removal of the card from the carton and inhibit intentional removal of the card.

11 Claims, 2 Drawing Sheets

U.S. PATENT DOCUMENTS

| | | | | |
|---|---|---|---|---|
| RE35,445 | E | 2/1997 | Pora | |
| 5,873,466 | A * | 2/1999 | Hulick | 206/531 |
| 5,954,202 | A | 9/1999 | Mellon | |
| 6,024,222 | A | 2/2000 | Friberg et al. | |
| 6,349,831 | B1 | 2/2002 | Buss | |
| 6,659,280 | B2 | 12/2003 | Paliotta et al. | |
| 6,679,382 | B1 | 1/2004 | Kancsar et al. | |
| 6,896,139 | B2 | 5/2005 | Kancsar et al. | |
| 6,964,338 | B2 | 11/2005 | Kancsar et al. | |
| 6,974,031 | B2 | 12/2005 | Kancsar et al. | |
| 7,025,207 | B2 * | 4/2006 | Breu et al. | 206/531 |
| 7,090,079 | B2 * | 8/2006 | Ehrlund | 206/531 |
| 2004/0026293 | A1 | 2/2004 | Hughes | |
| 2004/0035740 | A1 | 2/2004 | Paliotta et al. | |
| 2004/0108240 | A1 | 6/2004 | Ragot | |
| 2004/0188315 | A1 | 9/2004 | Morita et al. | |
| 2004/0232033 | A1 | 11/2004 | Paliotta et al. | |
| 2005/0035023 | A1 | 2/2005 | Breu et al. | |
| 2005/0103677 | A1 | 5/2005 | Fuchsberger | |
| 2005/0173291 | A1 | 8/2005 | Specker et al. | |
| 2005/0178692 | A1 | 8/2005 | Chang | |
| 2005/0183981 | A1 | 8/2005 | Gelardi | |
| 2005/0274643 | A1 | 12/2005 | Arnold | |
| 2005/0274644 | A1 | 12/2005 | Williams-Hartman | |
| 2006/0006091 | A1 | 1/2006 | Maietta | |
| 2006/0016718 | A1 | 1/2006 | Buss | |

* cited by examiner

UNITARY PHARMACEUTICAL PACKAGE

BACKGROUND OF THE INVENTION

This invention relates generally to packages and, more particularly, to packages containing a blister pack of medicine.

Generally, boxes or packages containing solid dose formulations of medicine contain several internal units in which the medicine is sealed, for example, in blister packs. A separate leaflet with instructions for use, contra-indications, dosing and other information will also be included for reference by the end-user on the correct use of the medicine. In many cases, such information is also contained on the carton. The cartons are often bulky and the blister packs may be removed by the end-user to facilitate transit of medicine, for example, in a handbag or wallet. In some instances, pharmaceutical companies provide samples to physicians in such packages and the blister pack is removed from the carton and stored while the carton is discarded to minimize storage space requirements.

Pharmaceuticals must be prepared in accordance with Good Manufacturing Practice (GMP) and this practice extends to the packaging of the end product. This is because a pharmaceutical product may be prepared to the required standards but if an error occurred where the product went into packaging for a different pharmaceutical, a patient may take a dose of their prescribed medication, for example, where the patient has an attack of asthma or angina, and if the medicine is wrong as a result of incorrect packaging, the dose will not relieve the symptoms. This could have serious repercussions and even be life threatening. So it is extremely important that medicines are packaged correctly in every aspect.

A pharmaceutical package incorporating a blister pack may provide useful instruction, information and advertising space for the manufacturer of a pharmaceutical composition contained therein. One major problem with pharmaceutical packages in which the blister pack or medication card is loose in the surrounding carton is that the medication card is often removed from the carton either accidently or intentionally. This can be quite problematic since the user loses the benefit of drug warning labels and other medication information contained on the carton as well as dosing requirements, drug interactions and other important information provided by the pharmaceutical company on the carton.

Accordingly, when the medicine is no longer located in its original packaging, which would provide greater protection than the blister pack alone, the safe and proper administration and use of the product is comprised. While a wide variety of packaging schemes are available, existing equipment and machinery often provide limited options for the expedient and economic packaging of blister packs.

SUMMARY OF THE INVENTION

These and other shortcomings in the prior art have been addressed by a unitary pharmaceutical package according to this invention. The package in one embodiment includes two primary components: a tubular sleeve-like carton or housing, and a medication card typically in the form of a blister pack in which multiple pre-formed pockets each enclose a pill. The medication card includes a clear semi-rigid upper sheet in which the individual blisters or bubbles are formed and a lower typically foil or other membrane which is adhered to the upper sheet. The individual blisters or bubbles are pressed downwardly and the pills rupture and pass through the foil as is well known in the industry. The medication card has at least one upturned lip or extension along a longitudinal end of the card.

The sleeve-like carton in one embodiment includes generally rectangular top and bottom panels and front and back panels. The ends of the carton are composite end walls formed by flaps which extend from the top, bottom, front and back panels. The flaps which project from the top and bottom panels are referred to as major end flaps in that their dimensions and configurations extend the entire width of the carton. The flaps which extend from the front and back panels are referred to as minor flaps in that they are significantly smaller than the major end flaps. When the major and minor end flaps are folded to be generally perpendicular to their associated panels, the associated end of the carton is closed and then typically sealed with adhesive.

One major problem with pharmaceutical packages in which the blister pack or medication card is loose in the surrounding carton is that the medication card is often removed from the carton either accidently or intentionally. This can be quite problematic since the user loses the benefit of drug warning labels and other medication information contained on the carton as well as dosing requirements, drug interactions and other important information provided by the pharmaceutical company.

To solve this problem and maintain the efficient manufacturing and production capabilities for pharmaceutical packages of this type, the unitary package of this invention easily and conveniently secures the medication card to the surrounding carton. Specifically, after the carton sleeve is erected but prior to closing at least one of the composite end walls, the medication card is inserted longitudinally through one of the open ends of the carton. If the medication card only includes one upturned extension, the end of the medication card opposite from the upturned extension is initially inserted into the carton. The minor end flaps are folded inwardly so that they are tucked inside the carton on the interior of the upturned extension on the medication card. The bottom major end flap is then folded upwardly to be juxtaposed in face-to-face relationship with the outer face of the upturned flange on the medication card. A strip of adhesive is then applied to the outer faces of the exposed portions of the upturned extension on the medication card and the lower major end flap. The upper major end flap is then folded downwardly to adhere to the exposed portions of the upturned extension and the lower major end flap.

As a result, the carton is closed and sealed with the medication card contained therein. The medication card is secured to the carton to avoid accidental removal of the card from the carton and inhibit intentional removal of the card.

The front and top panels of the card include a pair of score or tear lines by which an upper flap or access panel of the carton can be separated from the carton for access to the medication card therein. The user merely presses on one of the blister packs to push the pill through the lower foil of the medication card and an aligned perforated aperture in the bottom panel of the carton to receive the pill.

As such, the package according to the various embodiments of this invention solves the above-described and other problems with known packages for blister packs while utilizing existing carton production equipment and techniques.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
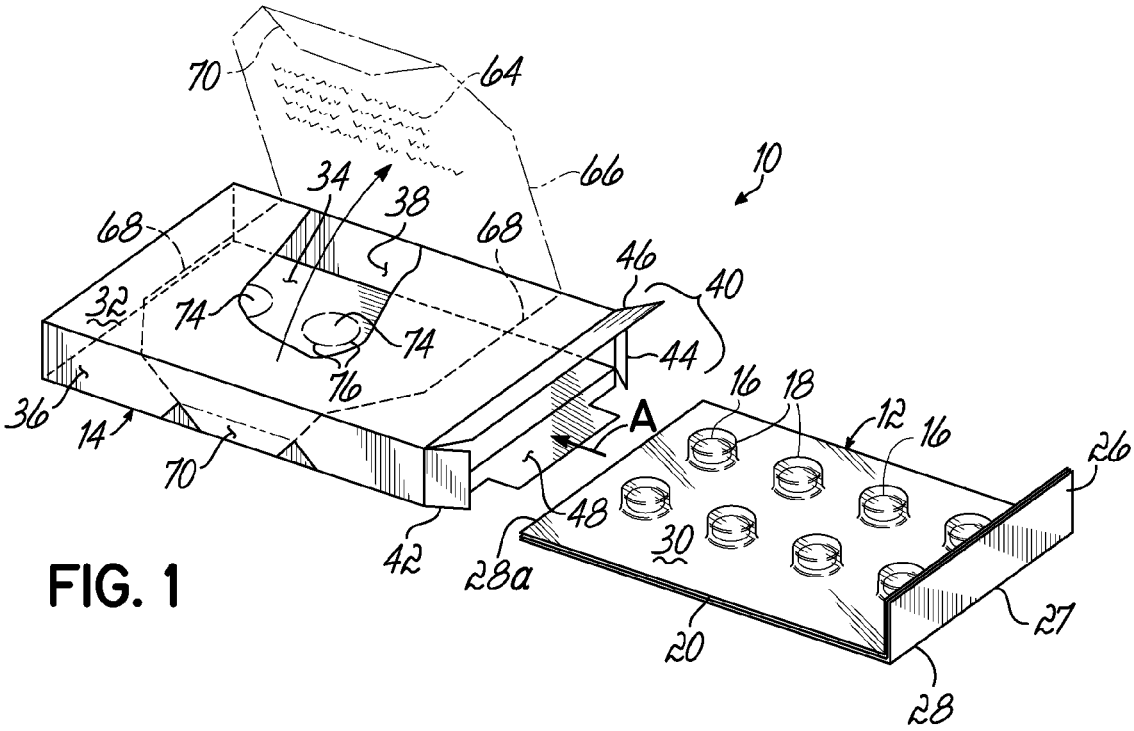
FIG. 1 is a perspective view of a medication card being inserted into a carton according to one embodiment of this invention.

Referring to FIG. 1, one embodiment of a unitary pharmaceutical package 10 according to this invention is shown. While the invention is described herein with respect to a package to be utilized for medicines, pharmaceuticals and the like, one of ordinary skill in the art will readily understand that this invention is readily applicable for packaging other items.

The pharmaceutical package 10 shown in FIG. 1 includes two primary components; namely, a medication card 12 and a carton 14, each of which are initially distinct elements that are combined together into a unitary package 10 according to this invention. The medication card 12 includes what is commonly referred to as a blister pack containing a number of discrete doses of medicine, pills, capsules 16 or the like. The medication card 12 includes a number of individual blisters or cavities 18, each of which contains at least one pill, capsule or dose of medicine 16. The medication card 12, as is common with typical blister packs, includes a thermo-form sheet 20 with the discrete blisters or cavities 18 formed therein. Typically, the sheet 20 is clear to provide a visual reference to the pills 16 contained in the individual cavities 18. The medication card 12 includes a sealing layer 24 such as foil or the like adhered to the bottom face of the sheet 20.

One feature of the medication card 12 according to the various embodiments of this invention is an extension 26 which, according to the embodiment shown in FIG. 1, is an upturned flange or lip along a longitudinal end 28 of the medication card 12. The extension 26 may be integrally formed with the sheet 20 of the medication card 12 and joined thereto along a joint 27 or of a different material joined at the joint 27 to the body of the medication card 12. The extension 26 as shown in FIG. 1 is oriented approximately 90° relative to the upper face 30 of the medication card 12 although other orientations and configurations of the extension 26 are well within the scope of this invention.

The carton 14 according to the embodiment of this invention shown in FIG. 1 is intended to contain the medication card 12 therein for transport, storage and dispensing of the pills 16. In one embodiment, the carton 14 includes generally rectangular, parallel and spaced top and bottom panels 32, 34 and generally rectangular, parallel and spaced front and back panels 36, 38. The top, front, bottom and back panels 32, 34, 36, 38 are joined together along fold lines between each of the adjacent panels. Opposite ends 40 of the carton 14 are formed as composite panels from end flaps extending from each of the panels 32, 34, 36, 38. Specifically, minor end flaps 42, 44 extend from the front and back panels 36, 38 and are joined to the respective panels along fold lines 50, 52. Major end flaps 46, 48 extend from the top and bottom panels 32, 34 and are joined to the respective panels by fold lines 54, 56. While only one composite end panel 40 of the carton 14 is shown in detail in FIG. 1, it should be readily appreciated that the opposite end panel may be likewise formed from the minor and major end flaps. Alternatively, the individual end panels may be formed in any other appropriate manner as is well know by those of ordinary skill in the art.

The carton 14 is sized and configured to receive therein the medication card 12 inserted through one of the open composite end panels 40 in the direction of arrow A as shown in FIG. 1. While the medication card 12 according to the embodiment shown in FIG. 1 has only one extension 26 on a longitudinal end 28 thereof, a similar extension 26 may be provided on the opposite longitudinal end 28*a* of the medication card 12 within the scope of this invention. As shown in FIG. 1, as the medication card 12 is inserted into the erected but yet to be closed, carton 14 through the open composite end panel 40, the end 28 of the medication card 12 with the extension 26 is the trailing end.

Figure 2:
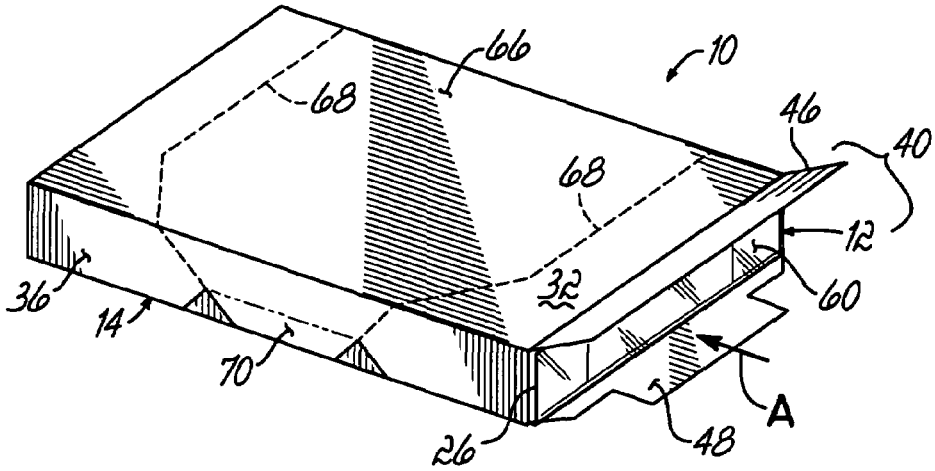
FIG. 2 is a view similar to FIG. 1 after the medication card is inserted into the carton and minor end flaps are folded inwardly.
Figure 2A:
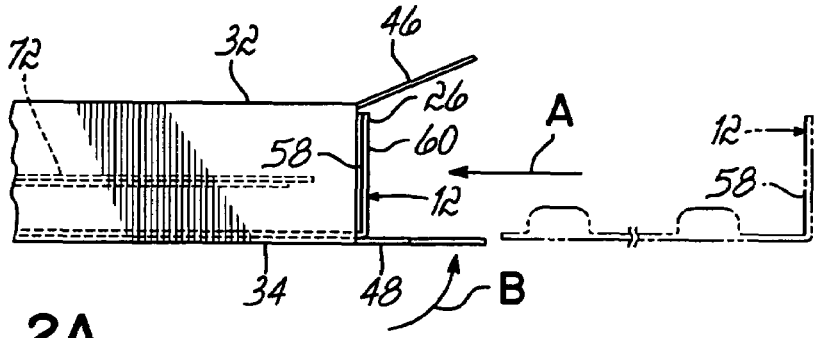
FIG. 2A is a side-elevational view of the arrangement shown in FIG. 2.
Figure 3:
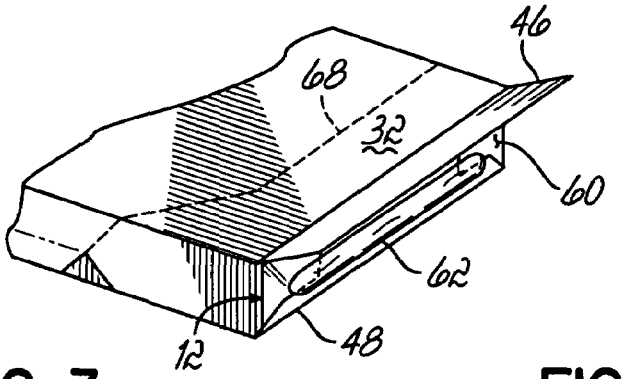
FIG. 3 is a perspective view of the one end of the carton of FIGS. 1-2 with the lower major end flap folded upwardly and adhesive applied thereto.
Figure 3A:
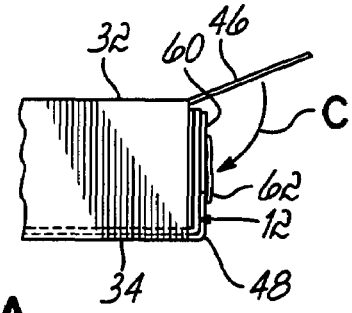
FIG. 3A is a side elevational view of the arrangement shown in FIG. 3.
Figure 4:
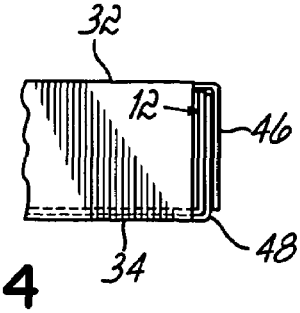
FIG. 4 is a side elevational view of the end of the carton closed and securing the medication card therein.

As the medication card 12 is inserted through the open composite end panel 40, the minor flaps 42, 44 are folded inwardly to be generally perpendicular to the panels 36, 38 of the carton 14 and juxtaposed to an inner face 58 of the extension 26 as shown in FIGS. 2 and 2A. After the medication card 12 is fully inserted into the carton 14 and the minor end flaps 42, 44 are juxtaposed to the inner face 58 of the extension 26, one of the major end flaps 46 or 48, such as the lower major end flap 48 as shown in FIG. 2A, is folded upwardly in direction of arrow B to be juxtaposed to an outer face 60 of the extension 26. An adhesive strip 62 is then applied to the lower major flap 48 and the outer face 60 of the extension 26 (FIG. 3), after which the remaining upper major end flap 46 is folded downwardly in the direction of arrow C to be adhered to the lower major end flap 48 and the extension 26 via the adhesive strip 62 (FIG. 3A).

While the package 10 according to this invention has been shown and described with only one extension 26 coupled to one of the composite end walls 40, the medication card 12 may include an extension 26 on each longitudinal end 28, 28*a* thereof and one or both of these extensions 26 could be coupled to the adjacent end wall 40 according to various embodiments of this invention. With the extension interleaved between the major and minor end flaps 42, 44, 46, 48 and secured thereto via the adhesive strip 62, the medication card 12 and carton 14 are united into a unitary package lo making it difficult for the medication card 12 and associated pills 16 to be easily removed from the carton 14. One advantage of the unitary package 10 according to this invention is that indicia or other patient information 46 which may be included on the carton 14 and is important to the safe and appropriate use of the medicine 16 on the medication card 12 remains available to the user.

As a result, the medication card 12 is securely coupled to the carton 14 and existing packaging and production machinery and techniques may be efficiently utilized without significant modification thereby ensuring economical and efficient production of a unitary package 10 according to this invention to avoid the loss of important information 46 and separation of the medication card 12 from the package 10.

After the medication card 12 and carton 14 are joined together as described, the user may access the pills 16 by pulling up an access panel 66 which, according to the embodiment shown in FIG. 1, is formed in the front and top panels 36, 32 of the carton 14 by a pair of similarly configured, mirror image score lines 68 extending there through. A finger tab 70 is accessible to the user on the front panel 36 which when peeled upwardly, tears the access panel 66 from the front and top panels 36, 32 along the score lines 68 thereby opening the carton 14 and providing access for the user to the medication card 12 within the carton 14 and important identifying indicia 64 and other information on the carton 14. While indicia 64 is shown as provided on an inner face of the access panel 66, it is readily understood that important patient information 64 may be provided on a leaflet 72 contained in the carton 14 (FIG. 2A) or on other portions of the package 10.

Figure 5:
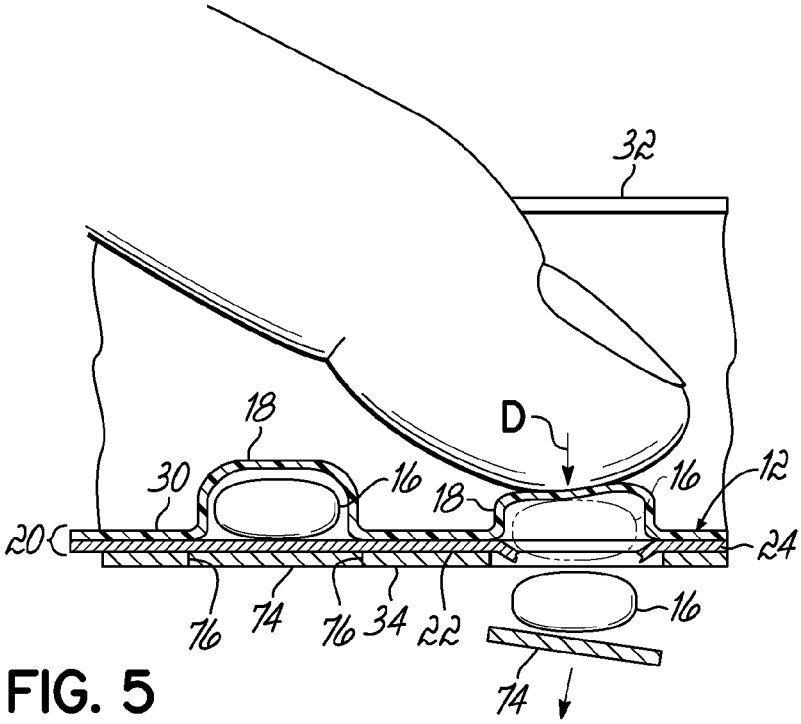
FIG. 5 is an enlarged cross-sectional view of a user dislodging a pill from the medication card contained in the carton according to one embodiment of this invention.

Once the package is opened via the access panel 66, a user may press downwardly on one of the blisters or cavities 18 to dislodge the pill 16 contained therein as shown in FIG. 5. In one embodiment, a series of buttons 74 are formed in the bottom panel 34 of the carton 14. Each blister cavity 18 on the medication card 12 is aligned with one of the buttons 74 such that when the user depresses downwardly in the direction of arrow D in FIG. 5 on one of the blisters 18, the pill 16 ruptures the sealing layer 24 and presses the button 74 downwardly from the bottom panel 34. The button 74 may be easily releasable from the bottom panel 34 by a series of score lines or perforations 76 as shown in FIGS. 1 and 5.

While one embodiment of the interrelationship between the end flaps 42, 44, 46, 48 and the extension 26 is shown and described herein, other arrangements and methods of coupling the extension 26 to the carton 14 can be utilized within the scope of this invention. Moreover, the package 10 may include additional features such as a child-resistant or tamper-evident feature without departing from the scope of this invention.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A pharmaceutical package comprising:

a medication card;

a plurality of cavities associated with the medication card, each of the cavities adapted to contain a dose of medicine;

an extension on the medication card generally perpendicular to a remainder of the medication card;

a carton adapted to surround and conceal the medication card therein, the carton further comprising, (a) a top panel;

(b) a bottom panel;

(c) a front panel;

(d) a back panel; and (e) a pair of composite end panels spaced from one another, each composite end panel of the carton being formed by a plurality of flaps extending from associated panels of the carton, wherein the plurality of flaps of one of the composite end panels include at least two minor end flaps juxtaposed to an inner face of the medication card extension and at least two major end flaps juxtaposed to an outer face of the medication card extension;

wherein the medication card is coupled to the carton when inserted therein by interleaving the medication card extension with at least some of the flaps of the one composite end panel to thereby inhibit removal of the medication card from the carton; and a deposit of adhesive located on at least part of the medication card extension and at least portions of the flaps to thereby adhesively secure the medication card to the carton.

2. The package of claim 1 further comprising:

an access panel in the carton which is adapted to be pulled from a remainder of the carton to provide access to the medication card therein.

3. The package of claim 2 wherein the carton is substantially erected with the exception of one of the composite end panels prior to insertion of the medication card therein.

4. The package of claim 3 wherein the carton and the medication card are distinct from one another prior to the extension being coupled to one of the composite end panels.

5. The package of claim 1 wherein the bottom panel of the carton is juxtaposed in face to face relation to a lower surface of the medication card, the package further comprising:

a plurality of buttons in the bottom panel, each of the cavities on the medication card being aligned with one of the buttons such that a user may push a dose of medicine from the package by rupturing a portion of the medication card and the button from the bottom panel.

6. The package of claim 1 wherein the carton is substantially erected with the exception of one of the composite end panels prior to insertion of the medication card therein.

7. The package of claim 1 wherein the carton and the medication card are distinct from one another prior to the extension being coupled to one of the composite end panels.

8. The package of claim 1 wherein the medication card further comprises:

a joint between the extension and a body of the medication card.

9. The package of claim 8 wherein the joint orients the extension obliquely relative to the body of the medication card.

10. The package of claim 9 wherein the extension is located at a longitudinal end of the medication card.

11. The package of claim 1 wherein the medication card further comprises:

a joint between the extension and the remainder the medication card, the joint orients the extension perpendicularly relative to the remainder of the medication card and the joint and extension are located at a longitudinal end of the medication card.

* * * * *